US006655183B1

(12) United States Patent
Fan

(10) Patent No.: US 6,655,183 B1
(45) Date of Patent: Dec. 2, 2003

(54) LIFTING MECHANISM FOR A HEAD MEMBER OF A PIPE BENDER

(75) Inventor: Shih-Tzung Fan, Tainan (TW)

(73) Assignee: Chiao Sheng Machinery Co., Ltd., Tainan Hsien (TW)

( * ) Notice: Subject to any disclaimer, the term of this patent is extended or adjusted under 35 U.S.C. 154(b) by 0 days.

(21) Appl. No.: 10/195,488

(22) Filed: Jul. 16, 2002

(51) Int. Cl.[7] ..... B21D 7/04
(52) U.S. Cl. ..... 72/157
(58) Field of Search ..... 72/149, 157, 158

(56) References Cited

U.S. PATENT DOCUMENTS 4,495,788 A * 1/1985 Traub ..... 72/157
5,263,350 A * 11/1993 Crippa ..... 72/157
5,950,474 A * 9/1999 George et al. ..... 72/149

* cited by examiner

*Primary Examiner*—Lowell A. Larson
(74) *Attorney, Agent, or Firm*—Rosenberg, Klein & Lee

(57) ABSTRACT

A lifting mechanism for a head member of a pipe bender includes a connecting block and an oil cylinder. The connecting block is fixedly connected to the head member. The oil cylinder is horizontally fitted to the main body of the pipe bender. The connecting block is equipped with a propped block on the bottom. The propped block has several spaced horizontal propped surfaces on the bottom thereof which are formed at different heights with slopes formed in between. Wheels are fitted to an outer end of the piston rod of the cylinder to prop up the propped block. Therefore, when die cylinder operates for the wheels to move relative to the propped block, the head member can be adjusted in height together with the connecting block. The piston rod stops moving when the wheels are positioned under a selected one of the horizontal propped surfaces.

2 Claims, 8 Drawing Sheets

LIFTING MECHANISM FOR A HEAD MEMBER OF A PIPE BENDER

BACKGROUND OF THE INVENTION

1. Field of the Invention

The present invention relates to a lifting mechanism for a head member of a pipe bender, and more particularly a lifting mechanism for a head member of a pipe bender, which can make the head member move up and down smoothly, and eliminate the risk of undesirable downward movement of the head member caused by oil leakage or other breakdowns of the hydraulic cylinder.

2. Brief Description of the Prior Art

Referring to FIGS. 7 and 8, a conventional pipe bender includes a head member 10, a molding member 20, a foldable hand member 30, and a feeding element 40. The head member 10 is tip and down movably disposed at a front end of the pipe bender. The molding member 20, and the foldable hand member 30 are fitted to the head member 10. Ad, the feeding member 40 is fitted on the main body of the pipe bender for feeding pipes to the head member 10.

The head member 10 is equipped with a rear guide block 101, a rear guide mould 102, a guide block 103, and a guide mould 104. The molding member 20 consists of several decks of molding wheels 201 of different diameters. The foldable hand member 30 includes an upper clipping element 301, and a lower clipping element 302 arranged beside corresponding molding wheels 201.

In using such pipe bender, pipes fed to the head member 10 via the guide moulds 102, 104 on the head member 10 are clipped by means of one of the clipping elements 301, and 302. Then, the clipping element 301 or 302 operate to press the pipes over the corresponding molding wheel 201 so that the pipes are bent in conformity with shapes and diameters of the molding wheel 201.

Referring to FIGS. 9 and 10, the head member 10 is fitted to vertical guide rails at one side, and equipped with a lifting mechanism 50 comprising a hydraulic cylinder 501, which is disposed under the head member 10 with a piston rod 502 propping the bottom of the head member 10. Thus, the lifting mechanism 50 can be operated to adjust the height of the head member 10. After the head member 10 is adjusted to a desired height, pipes fed from the feeding member 40 can be clipped by one of the clipping elements 301, 302 that is as high as it, and then shaped in accordance with the corresponding molding wheel 201 when the clipping element is operated.

However, the lifting mechanism for head member is found to have disadvantages as followings:

1. The entire weight of the head member 10 is supported by the cylinder 501 therefore the lifting mechanism will have shortened service life. And, the head member will undesirably move down due to gravity if there is breakdown in the cylinder or leakage in the oil circuit.
2. The head member 10 is prone to vibrate because it is relatively heavy in weight. Consequently, the head member 10 will have reduced precision.
3. Because the hydraulic cylinder 501 of the lifting mechanism is disposed under the head member 10, it is likely to interfere with bending process of pipe benders.

SUMMARY OF THE INVENTION

It is a main object of the present invention to provide a lifting mechanism for a head member of a pipe bender such that the head member can be moved up and down smoothly.

It is another object of the present invention to provide a lifting mechanism for a head member of a pipe bender such that an oil cylinder thereof do not have to bear the weight of the head member after the head member has been moved to desired position, eliminating the risk of undesirable downward movement of the head member caused by oil leakage or other breakdowns of the hydraulic cylinder.

The present lifting mechanism includes a connecting block, and an oil cylinder. The connecting block is joined to the head member. The oil cylinder is horizontally fitted to the main body of the pipe bender. The connecting block is equipped with a propped block on the bottom. The propped block has several horizontal propped surfaces on the bottom, which are formed at different heights with slopes formed in between. Wheels are fitted to the piston rod of the cylinder to prop up the propped block. Therefore, when the cylinder operates for the wheels to move relative to the propped block, the head member can be moved up and down. The piston rod stops moving when the wheels are positioned under one of the horizontal propped surfaces, therefore the cylinder don't have to bear the weight of the head member all the time.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
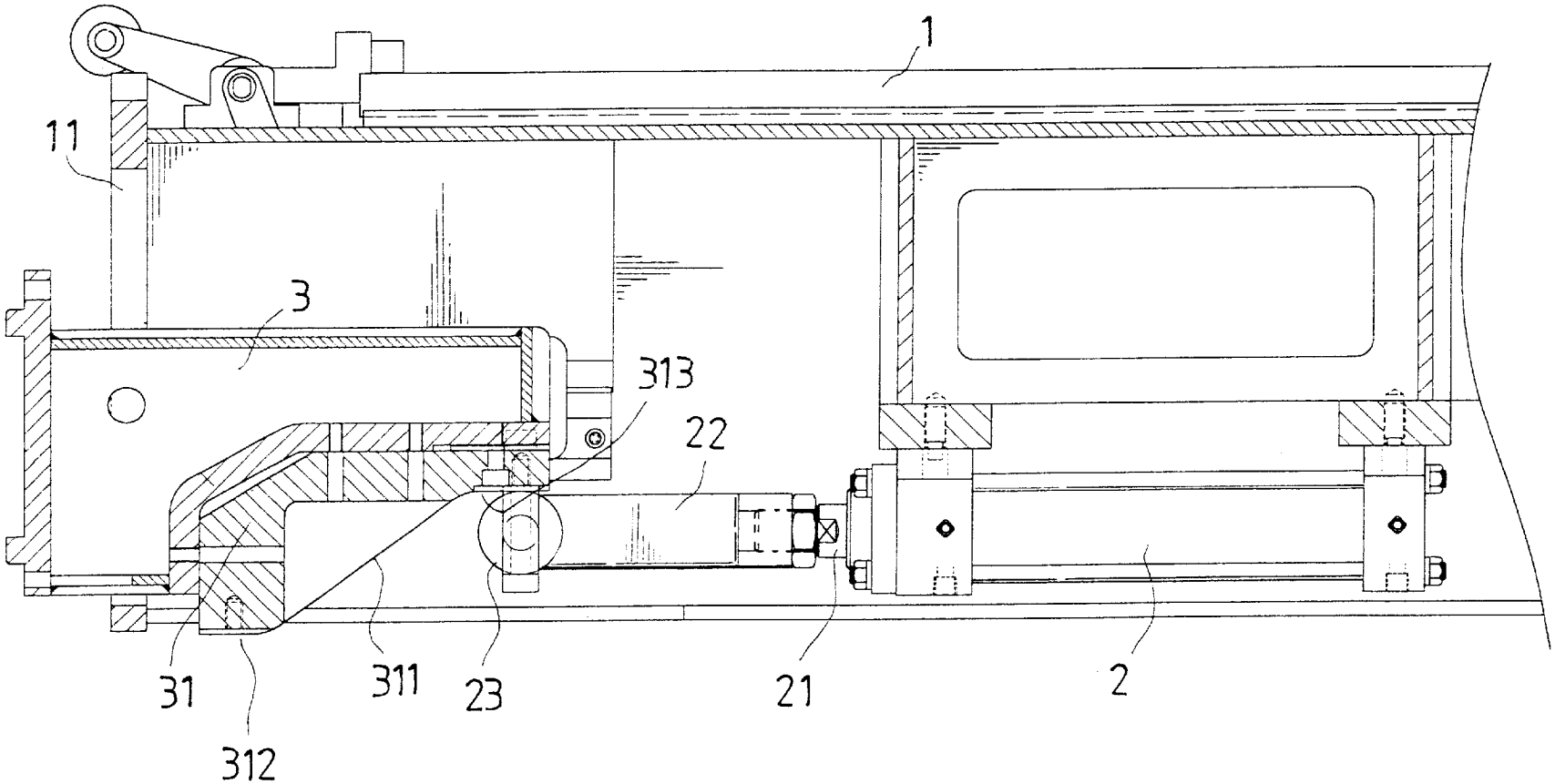
FIG. 1 is a cross-sectional view of the lifting mechanism for a head member of a pipe bender according to the present invention.
Figure 2:
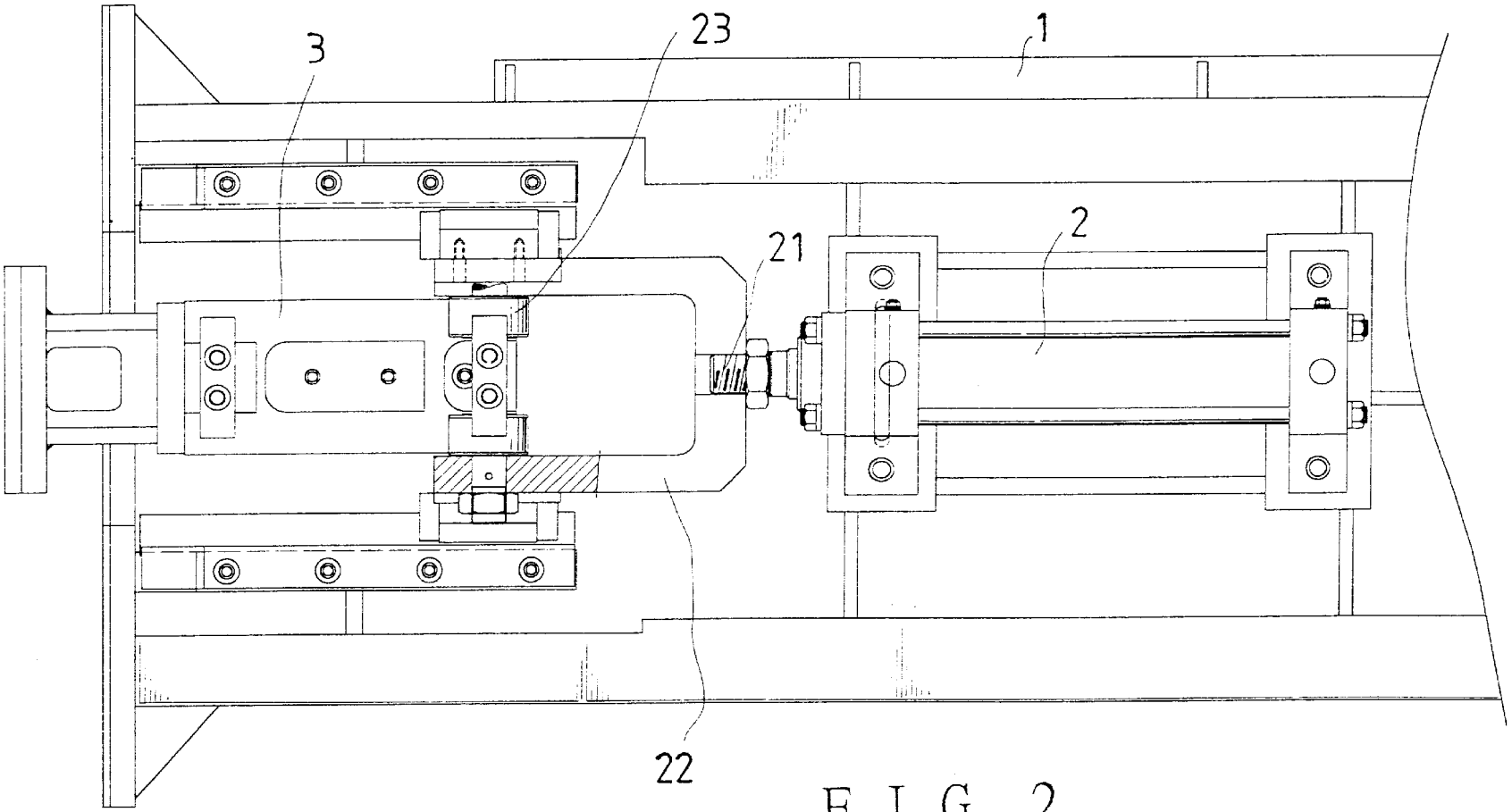
FIG. 2 is a top view of the lifting mechanism for a head member of a pipe bender according to the present invention.
Figure 3:
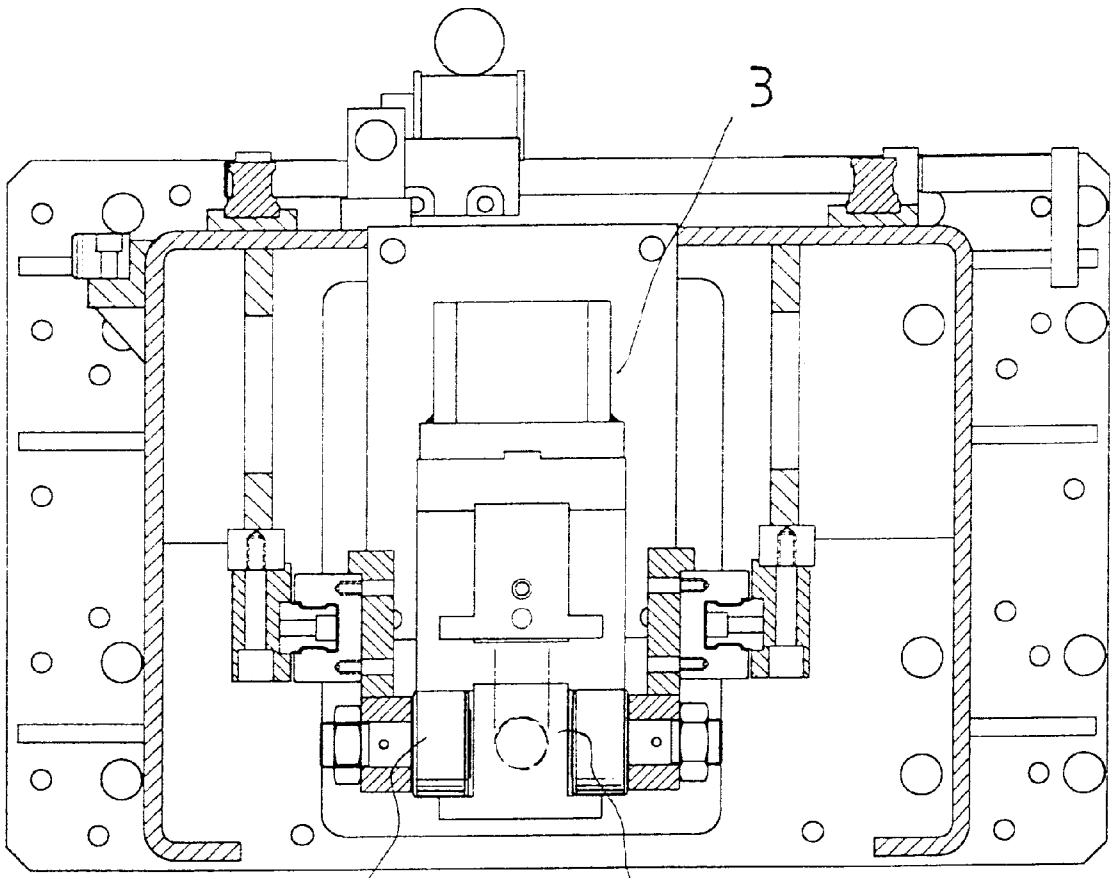
FIG. 3 is another side view of the lifting mechanism of the present invention.
Figure 4:
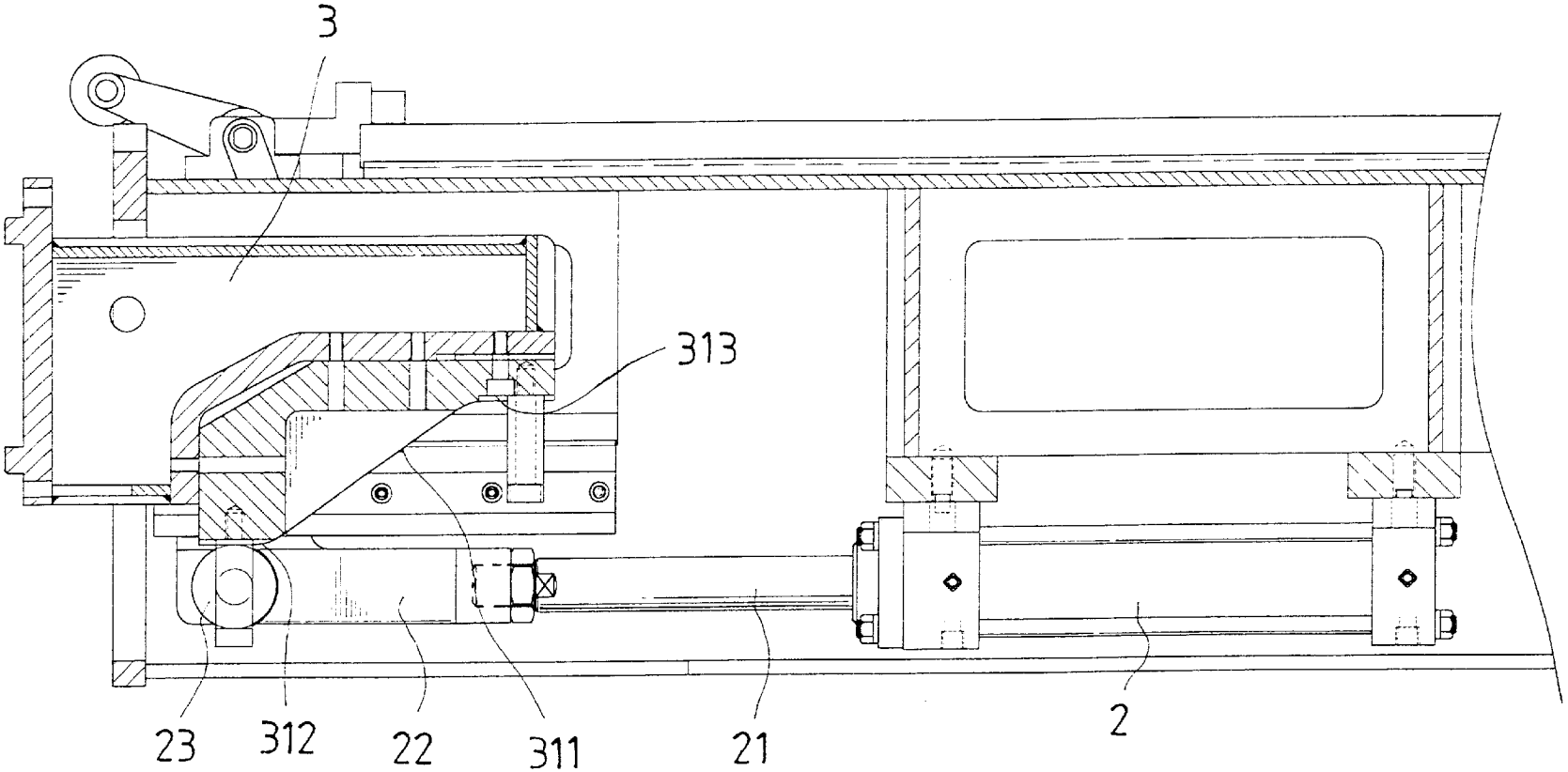
FIG. 4 is a view of the lifting mechanism of the present invention under operation.

Referring to FIGS. 1, 2 and 3, a lifting mechanism according to the present invention is fitted to a main body 1 of a pipe bender, which is substantially the same as the one described in the Background. The present lifting mechanism includes an oil cylinder 2, and a connecting block 3.

The oil cylinder 2 is fitted to the main body 1 of the pipe bender in a horizontal position, and has a piston rod 21 directed to an opening of the main body 1. A pushing support 22 is connected to an outer end of the piston rod 21 at a first end thereof The pushing support 22 is equipped with wheels 23 at other end.

The connecting block 3 includes a connecting portion 32. The connecting block 3 is associated with vertical guide rails (not shown) on the front of the main body 1 so that it can be moved up and down. The connecting portion 32 sticks out through the opening 11 of the main body 1, and is fixedly joined to a head member of the pipe bender so that the head member can be moved together with the connecting block 3. A propped block 31 is joined to a lower side of the connecting block 3. The propped block 31 is formed with spaced horizontal propped surfaces 312, and 313 at different heights. The propped block 31 further has a slope 311 formed between the propped surfaces 312, and 313. Thus, the wheels 23 are faced with the slope 311, and the propped surfaces 312, 313.

To adjust the head member of the pipe bender in height the oil cylinder 2 is operated to move the piston rod 21 so that the wheels 23 move relative to the slope 311. The movement of the piston rod 21 is stopped when the wheels 23 prop up the propped block 31 by means of positioning the same under a selected one of the horizontal propped surfaces 312, 313. Thus, the head member is stably supported at desired height together with the connecting block 3, allowing pipes fed from the main body 1 to be pressed over a corresponding one of molding wheels disposed on the head member in the pipe bending process. The cylinder 2 operates for the piston rod 21 to retreat so that the head member is lowered, allowing pipes fed from the main body 1 to be pressed over an upper one of the molding wheels.

Figure 5:
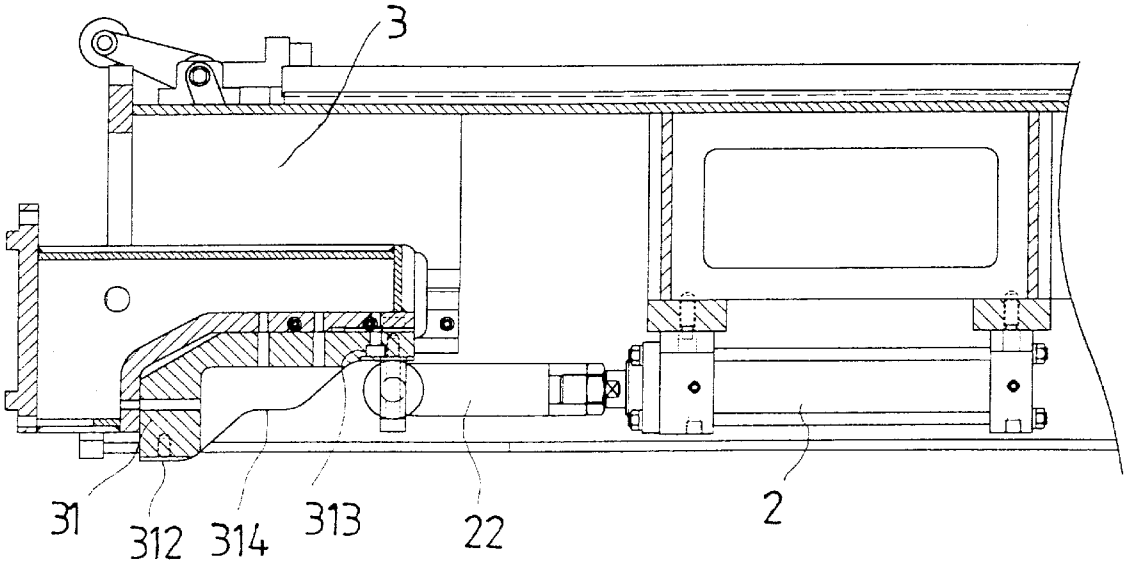
FIG. 5 is a side view of the lifting mechanism according to the second embodiment of the present invention.

Referring to FIG. 5, a propped block 31 of the second embodiment is formed with more than two horizontal propped surfaces 312, 313, and 314 at different heights, and similarly slopes are formed between the propped surfaces. Thus, there are more options in adjusting height of the head member.

Figure 6:
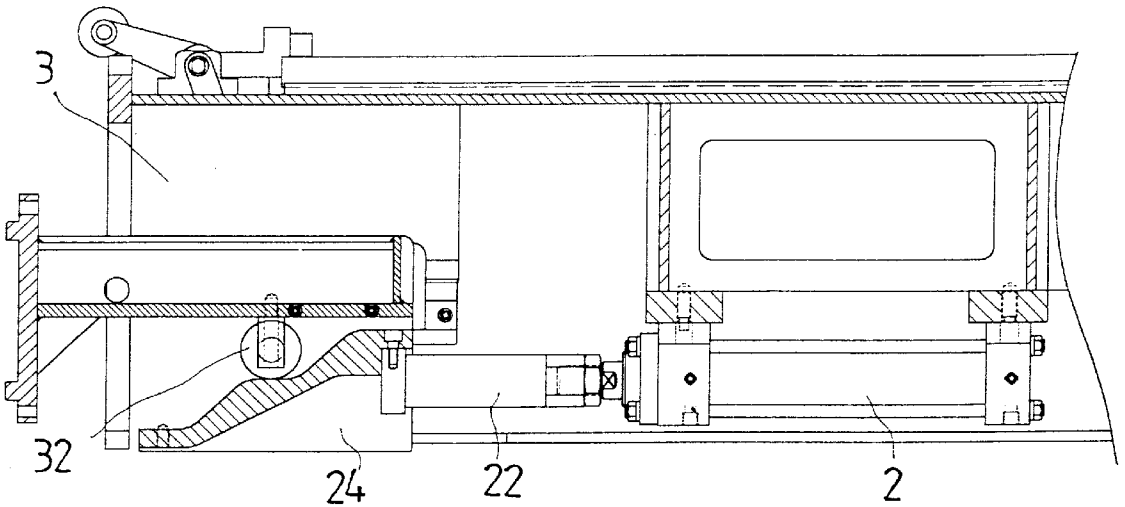
FIG. 6 is a side view of the lifting mechanism according to the third embodiment of the present invention.
Figure 7:
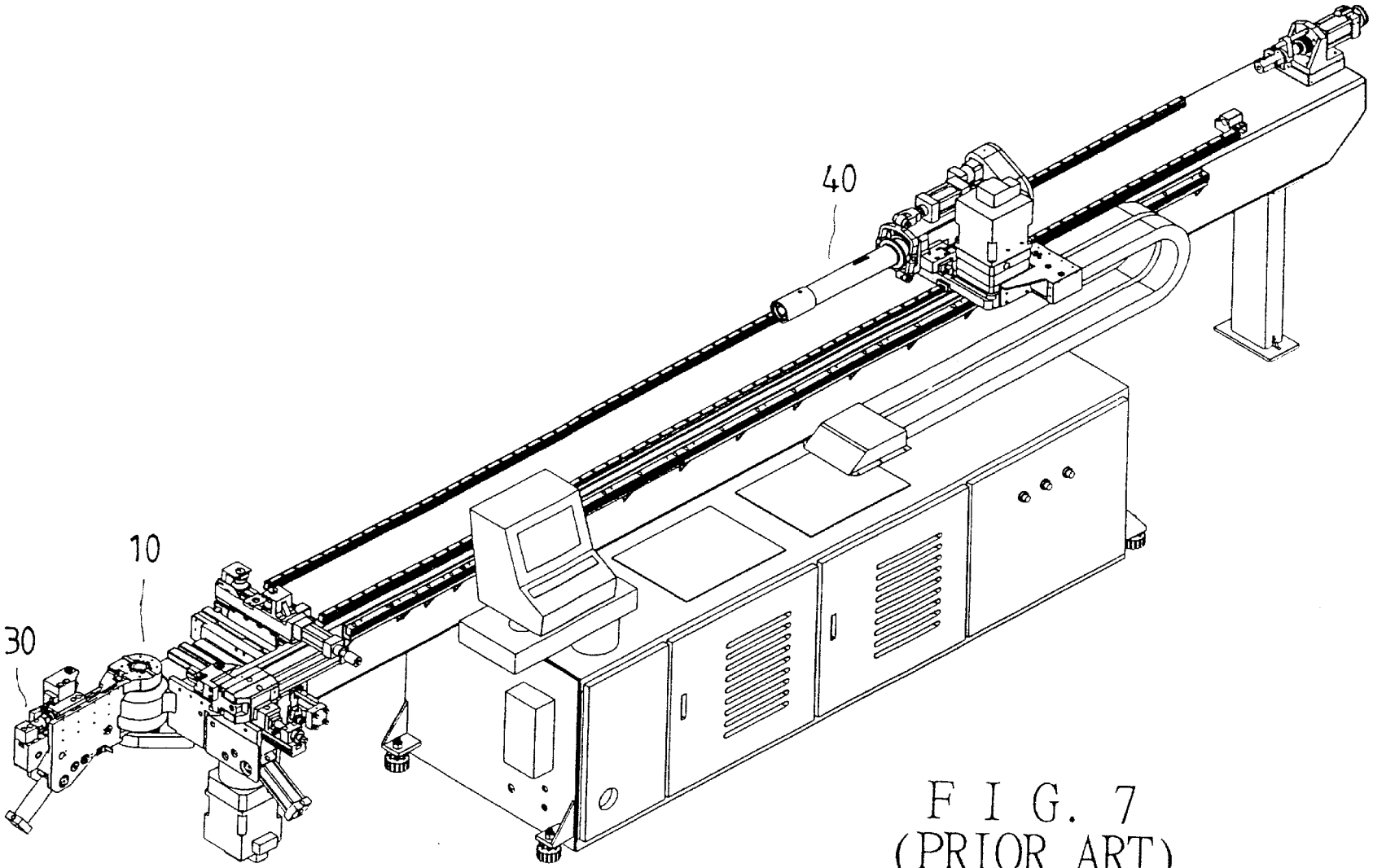
FIG. 7 (PRIOR ART)
FIG. 7 is a perspective view of the conventional pipe bender as described in the Background.
Figure 8:
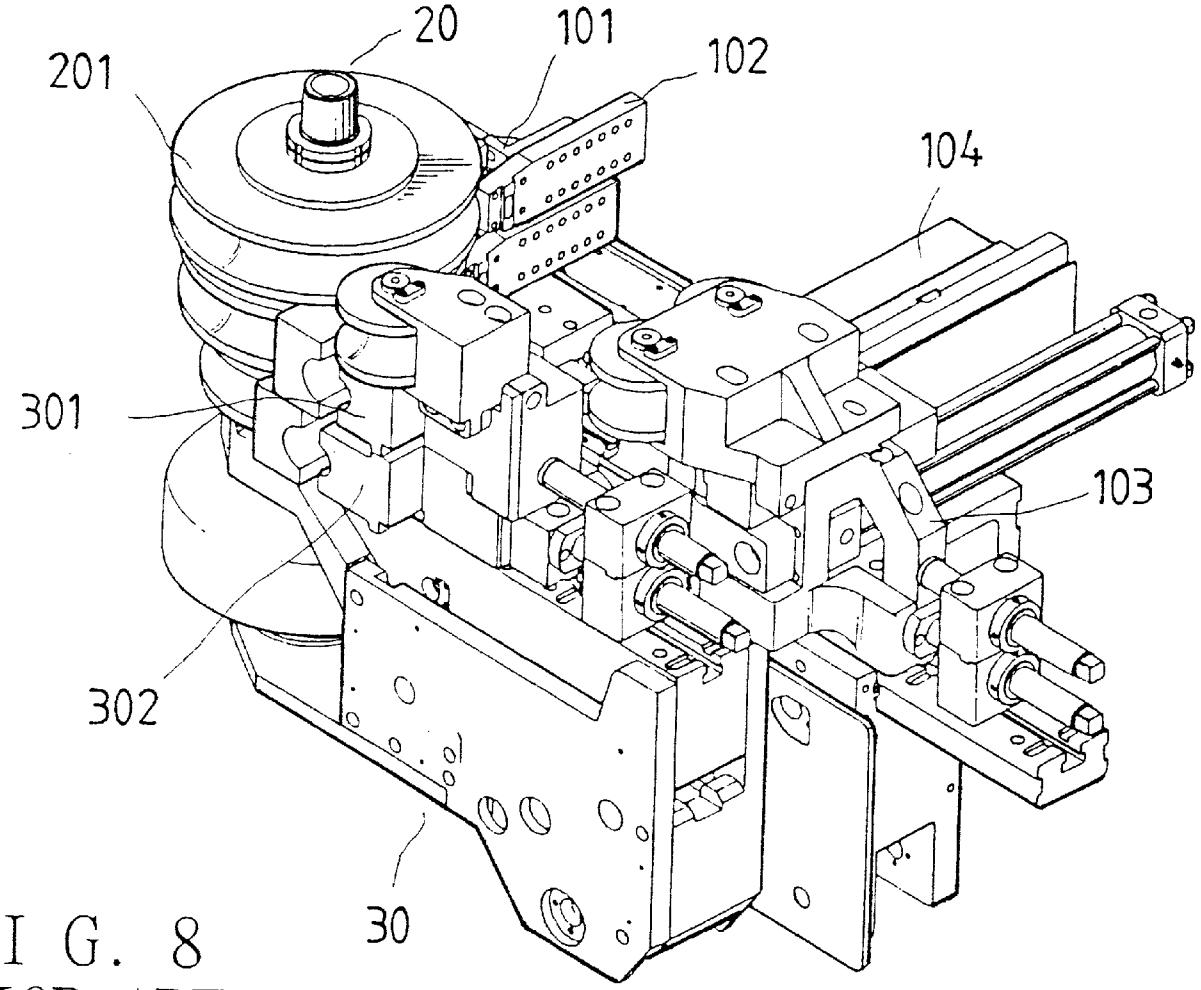
FIG. 8 (PRIOR ART)
FIG. 8 is a perspective view of the head member of the conventional pipe bender in FIG. 7.
Figure 10:
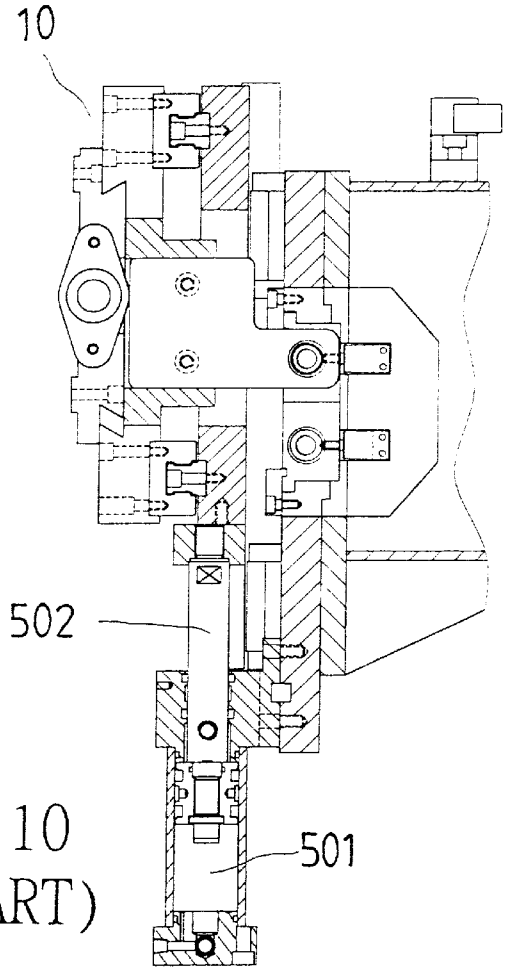
FIG. 10 (PRIOR ART)
FIG. 10 is a side view of the head member of the conventional pipe bender.
Figure 9:
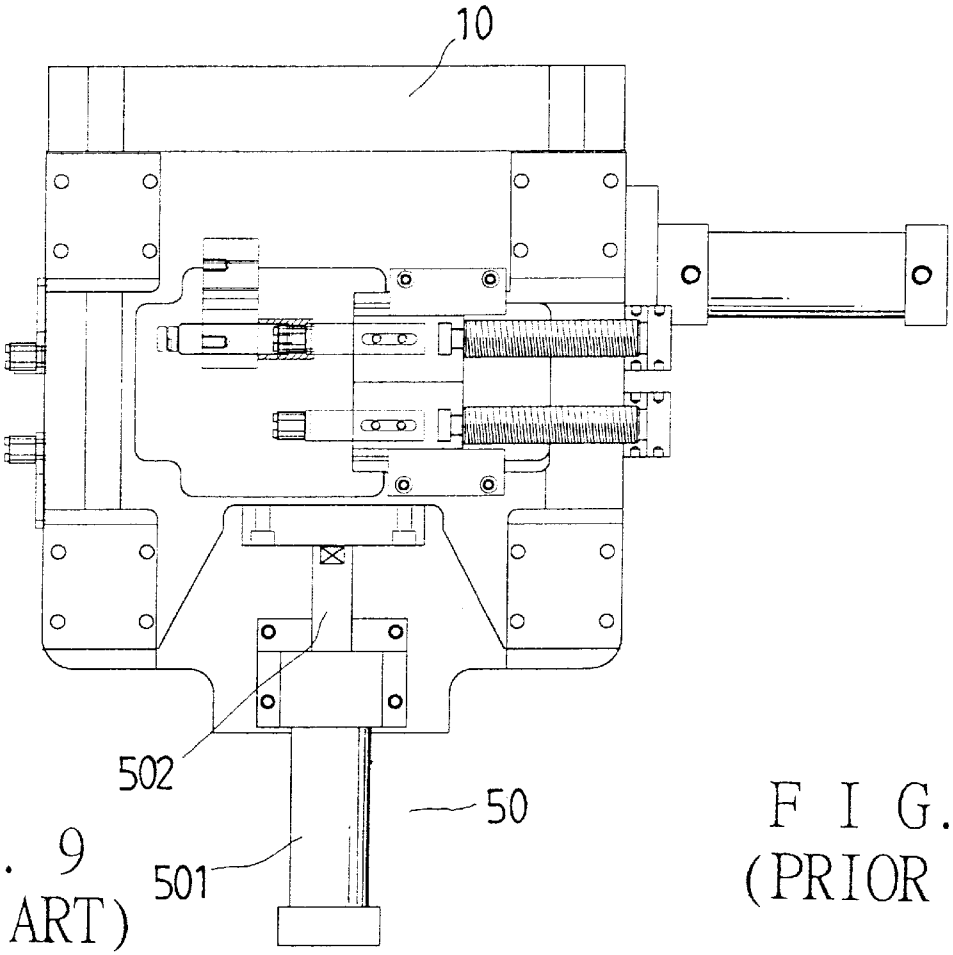
FIG. 9 (PRIOR ART)
FIG. 9 is a front view of the head member of the conventional pipe bender.

Referring to FIG. 6, in yet another embodiment of the present invention, wheels 32 are fitted to a bottom of the connecting block, and a propping block 24 is fixedly connected to the pushing support 22, which is joined to the outer end of the piston rod 22. The propping block 24 has several spaced horizontal propping surfaces (not numbered) on an upper side thereof. The paced horizontal propping surfaces are formed at different heights with slopes formed in between.

Therefore, when the oil cylinder 2 is operated to move the piston rod, the propping block 24 will move relative to the wheels 32. The movement of the piston rod is stopped when the propping block 24 prop up the wheels 32 with a predetermined one of the horizontal propping surfaces being positioned under the wheels 32. Thus, the head member is stably supported at desired height together with the connecting block 3.

From the above description, it can be easily seen that the lifting mechanism for a head member of a pipe bender of the present invention has advantages as followings:

1. The entire weight of the head member is supported by the wheels instead of by the cylinder therefore there is no possibility of service life of the oil cylinder being shortened due to the persistent pressure from the head member. And, the head member will still be stably supported in position even if there is breakdown in the cylinder or leakage in the oil circuit.
2. With the wheels and the shaped block working together to move the bead member up and down, vibration of the head member with the present lifting mechanism is relatively little as compared with that occurring in the conventional head member. Consequently, precision of the head member will not be reduced by vibration.
3. The oil cylinder and the propping block of the lifting mechanism is disposed in the main body of the pipe bender instead of under the head member, therefore they will not interfere with bending process of pipe benders, allowing the pipe bender to operate smoothly.

What is claimed is:

1. A lifting mechanism for a head member of a pipe bender, comprising a connecting block fixedly connected to a head member of a pipe bender; the connecting block being up and down movably disposed in a main body of the pipe bender with a connecting portion sticking out from the main body for connection to the head member;

a propped block fixedly connected to a bottom of the connecting block; the propped block having a plurality of horizontal propped surfaces on a bottom thereof, the horizontal propped surfaces being formed at different heights with slopes formed in between;

an oil cylinder horizontally fitted to the main body of the pipe bender; the oil cylinder having a piston rod; and, a pushing support connected to an outer end of the piston rod at a first end thereof; the pushing support being equipped with wheels at other end to face the slopes of the bottom of the propped block;

whereby the head member can be adjusted in height together with the connecting block by means of operating the oil cylinder to move the wheels relative to the propped block to a selected one of the horizontal propped surfaces, allowing pipes fed from the main body to be shaped by a corresponding one of molding wheels on the head member in bending process.

2. A lifting mechanism for a head member of a pipe bender, comprising a connecting block fixedly connected to a head member of a pipe bender; the connecting block being up and down movably disposed in a main body of the pipe bender with a connecting portion sticking out from the main body for connection to the head member; a plurality of wheels being fitted to a bottom of the connecting block;

an oil cylinder horizontally fitted to the main body of the pipe bender; the oil cylinder having a piston rod;

a propping block fixedly connected to an outer end of the piston rod; the propping block having a plurality of horizontal propping surfaces on an upper side thereof, the horizontal propping surfaces being formed at different heights with slopes formed in between;

whereby the head member can be adjusted in height together with the connecting block by means of operating the oil cylinder to move the propping block relative to the wheels until a selected one of the horizontal propping surfaces is positioned under the wheels, allowing pipes fed from the main body to be shaped by a corresponding one of molding wheels on the head member in bending process.

* * * * *